US006434981B2

(12) United States Patent
Fantl et al.

(10) Patent No.: US 6,434,981 B2
(45) Date of Patent: Aug. 20, 2002

(54) COMBINATION LOCK

(75) Inventors: Steven A. Fantl, Colgate; James L. Welch, Waukesha; Jesse A. Marcelle, Franklin; John W. Grosz, Waupun; Edward A. Raleigh, Waunakee, all of WI (US)

(73) Assignee: Master Lock Company, Milwaukee, WI (US)

( * ) Notice: Subject to any disclaimer, the term of this patent is extended or adjusted under 35 U.S.C. 154(b) by 0 days.

(21) Appl. No.: 09/795,846

(22) Filed: Mar. 1, 2001

Related U.S. Application Data

(60) Provisional application No. 60/186,291, filed on Mar. 1, 2000.

(51) Int. Cl.[7] ..... E05B 37/06

(52) U.S. Cl. ..... 70/25; 70/56; 70/313; 70/314

(58) Field of Search ..... 22/22, 24–26, 22/54–56, 313, 314, 303 R, 303 A

(56) References Cited

U.S. PATENT DOCUMENTS

| | | | | | |
|---|---|---|---|---|---|
| 2,113,864 | A | * | 4/1938 | Soref et al. | 70/314 |
| 3,979,932 | A | * | 9/1976 | Piche | 70/26 X |
| 4,111,014 | A | * | 9/1978 | Epstein | 70/25 |
| 5,156,029 | A | * | 10/1992 | Heald | 70/55 |

* cited by examiner

*Primary Examiner*—Lloyd A. Gall
(74) *Attorney, Agent, or Firm*—Calfee, Halter & Griswold LLP

(57) ABSTRACT

A combination lock having a housing, a shackle, a dial, a pushbutton, and a lock assembly. The lock assembly is made of a group of rotating disks having windows that can be aligned to open the lock. When the dial is turned according to the combination of the lock, the windows become aligned so that the user can depress the pushbutton to release the shackle. The pushbutton travels in a direction that is perpendicular to the axis of rotation of the dial. When the shackle is locked again, the pushbutton returns to its original position. As the pushbutton travels back to its original position, portions of the lock assembly are turned so that the combination must be reentered in order to reopen the lock.

7 Claims, 9 Drawing Sheets

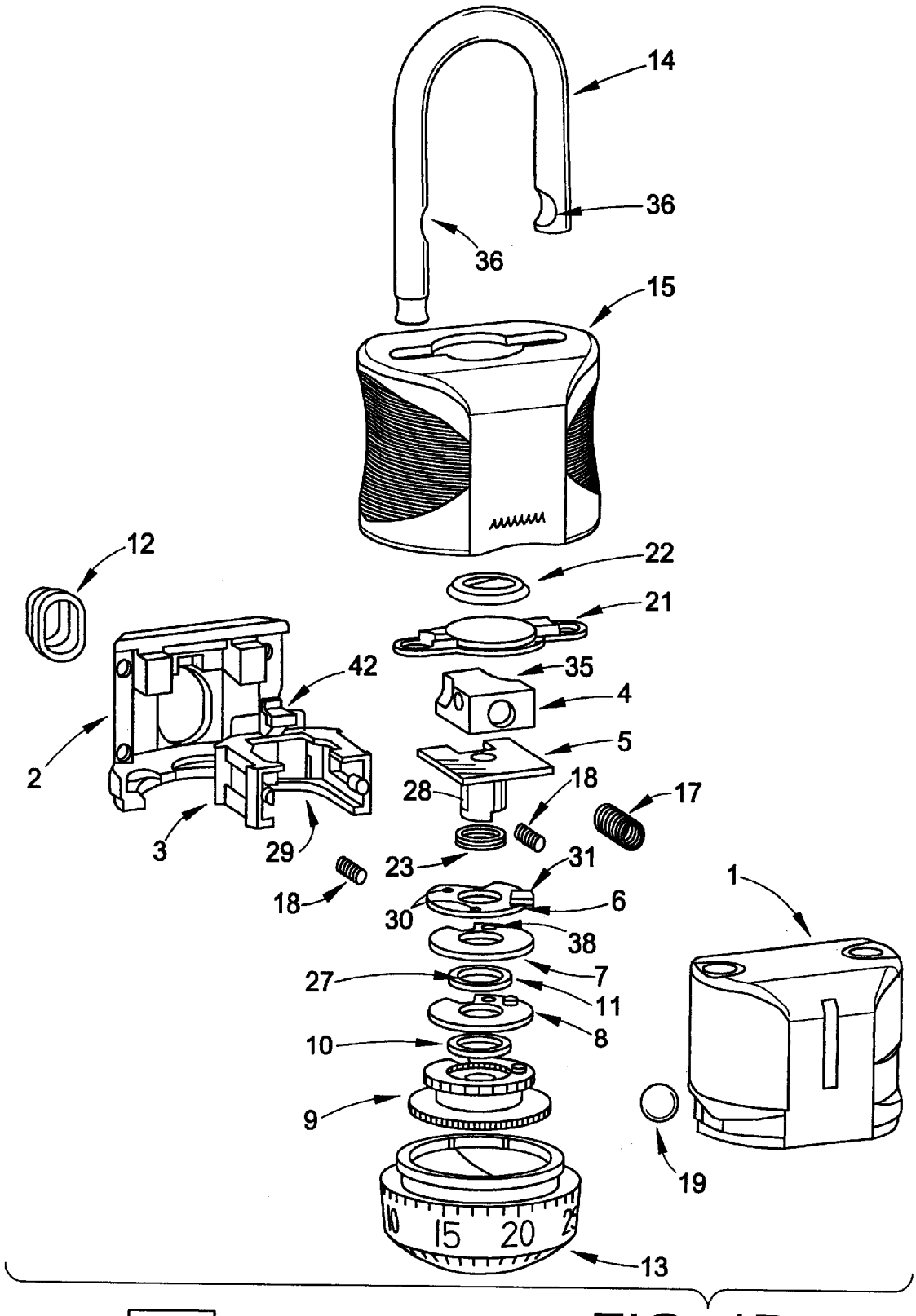
FIG. 1B
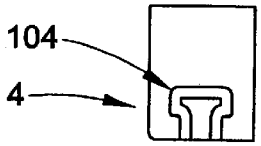
FIG. 1B1

COMBINATION LOCK

RELATED APPLICATIONS

This application claims priority to provisional patent application, U.S. Ser. No. 60/186,291, filed Mar. 1, 2000, which is hereby incorporated by reference.

BACKGROUND OF THE INVENTION

The present invention relates to an improved combination lock. Combination locks are convenient devices since they do not require the use of keys. They are widely used on brief cases, trunks, etc. In addition, combination locks also can be used to lock doors, drawers, or lockers. On occasion, these locks may be used outdoors or under harsh environmental conditions that, over an extended period of time, may cause the locks to no longer operate properly. As explained more fully below, the present invention provides for improved weather resistance.

In addition, the present invention provides for increased resistance to unauthorized opening of the lock. Typically, combination locks utilize a plurality of disc-like tumblers each having a radial slot in one particular position. To open a conventional combination lock, the tumblers are rotated by a dial on the face of the lock in a prescribed manner so that all of the slots are in alignment and the shackle can be opened. As explained in U.S. Pat. No. 4,111,014, efforts have been made in the past to increase the security of the lock by making the dial turn smoothly. These efforts to provide increased security, however, have contributed to the difficulty of correctly turning the dial to the prescribed combination. The face of a conventional dial often is marked with numerals so that the user can turn the dial to the proper position to unlock the lock. These markings usually are separated by very small distances. The result is that sometimes the user may not properly turn the dial to its correct location. For instance, the dial may not be completely turned to the correct position, or alternatively it may be turned too far. These errors may be attributed to the user not being able to tell when the dial has been turned to its proper position, or also may be caused by overly rapid turning of the dial so that it is stopped at an incorrect position. As explained below, the present invention provides for easier, more accurate rotation of the dial without sacrificing security of the lock.

The present invention also improves the security of the lock. In the past, skilled persons have attempted unauthorized opening of such locks by applying high impact forces to the shackle, dial, or body of the lock to force it open. The present invention increases resistance to these unauthorized attacks in a number of ways, each of which is described more fully below.

Finally, conventional locks usually are mass produced in a manner that do not allow for customization to receive a logo or other design, or to suit a purchaser or particular customer segment without either incorporating these steps in the manufacture of the lock or exposing the lock to harmful elements. The present invention allows for customization of the lock after it has been assembled and without reducing the weather resistance or integrity of the lock.

SUMMARY OF THE INVENTION

The present invention is directed to an improved combination lock.

In one embodiment, the lock has a combination assembly made of rotatable disks. The disks have clearance pockets that, when aligned, allow a pushbutton to be depressed in order to open the lock. The pushbutton and disks are configured so that as the button returns to its original position the disks are rotated out of alignment, thereby requiring the combination to be reentered in order to reopen the lock.

In another embodiment, the combination dial and pushbutton of the lock are positioned so that the pushbutton operates in a direction perpendicular to the rotational axis of the dial. Preferably, the dial is located on the bottom face of the lock housing. Another embodiment of the present invention includes a collapsible cover over the pushbutton. The cover is designed to collapse under impact force to provide increased security against unauthorized attempts to open the lock by force.

In yet another embodiment, the combination lock has improved weather resistance. In this embodiment, the lock has a flexible insert with through holes for receiving the shackle. In one embodiment, the through holes have a diameter slightly less than the diameter of the legs of the shackle. The material around the through holes stretches to accommodate the shackle, thereby creating a seal that provides greater resistance to water, dust, or other impurities that may harm the lock. In another embodiment, the through holes have a diameter approximately the same as the shackle, or alternatively may be slightly larger than the shackle. In these embodiments, the edge of the through holes may have ribs that contact the shackle to provide increased weather resistance while resulting in less frictional force when the shackle is moved in or out of the lock.

BRIEF DESCRIPTION OF THE DRAWINGS

The foregoing and other features of the present invention will be more clearly understood from the following detailed description and the accompanying drawings, in which, FIGS. 1A–B is an exploded view of a combination lock of the present invention;

FIG. 1B1 is a bottom view of a blocker of a combination lock of the present invention.

DETAILED DESCRIPTION OF THE PRESENT INVENTION

Figure 1A:
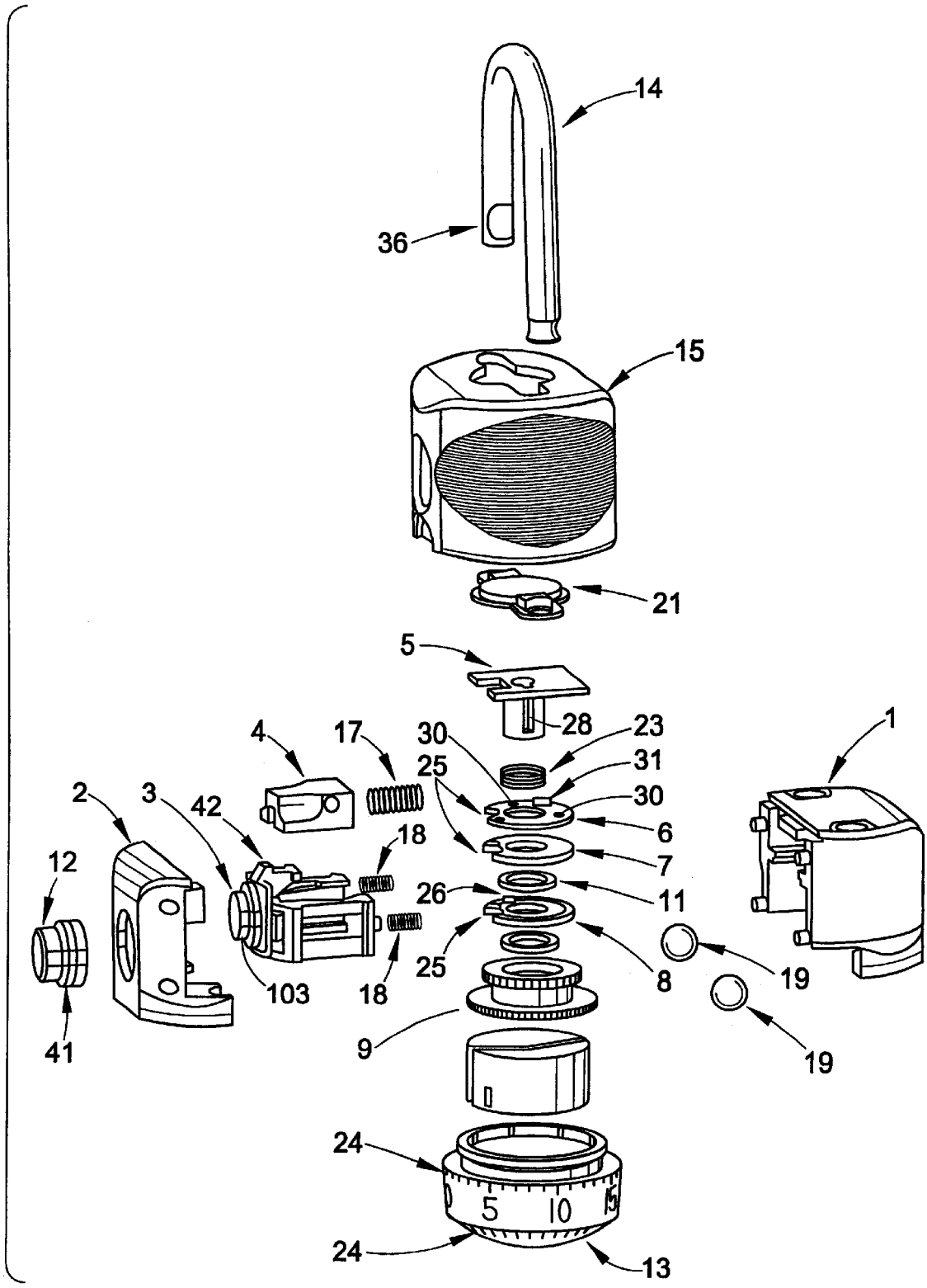

The present combination lock is similar in operation to the portable combination locks typically seen in schools, gyms, storage facilities, and the like. Despite these similarities, however, there are a number of significant differences in the structure and operation of the present invention. FIG. 1 shows an exploded view of a preferred embodiment for the present invention. In the embodiment shown, the dial 13 of the present combination lock is on the bottom of the lock instead of in the conventional location of the front face. In addition, the present combination lock has a pushbutton 3 that may be depressed after the combination is entered in order to release the shackle 14 from its locked position. Thus, once the three numbers are dialed, the user simply depresses pushbutton 3 on the front of the product to unlock the lock. Preferably, the pushbutton 3 is oriented so that its direction of motion is approximately perpendicular to the axis around which dial 13 rotates.

General operation of the present invention is as follows. The dial 13 has a plurality of markings 24 to indicate to the user where the dial 13 should be turned to correctly enter the combination. Preferably, the markings include numeric indications, although other symbols also may be used. The body of the lock has an indicator to which the user aligns the markings on the dial according to the lock combination. Inside the lock are a combination upset disk 6, a top combination disk 7, a middle combination disk 8, and a combination cam disk 9. The combination upset disk 6, top combination disk 7, middle combination disk 8, and combination cam disk 9 have cutouts 25, or clearance pockets, that when properly aligned allow pushbutton 3 to be depressed so that the shackle 14 can be opened.

As viewed from the bottom of the lock, the dial 13 first is rotated clockwise three full rotations and stopped when the indicator is aligned with the first number or symbol of the combination. This ensures that the top combination disk 7 and middle combination disk 8 are engaged by the combination cam disk 9 and that the combination upset disk 6 is advanced to its stop position. When the dial 13 is turned to the first position of the combination, the combination upset disk 6 and the top combination disk 7 are properly aligned so that the alignment of the remaining disks will allow the lock to be opened. As would be appreciated by one skilled in the art, the number of rotations, as well as the direction of rotation, are illustrative but not limiting. Thus, the amount and direction of rotation may be varied without departing from the spirit and scope of the present invention.

The engagement of the top combination disk 7 and middle combination disk 8 with the combination cam disk 9 is accomplished by protrusions 26, or nibs, extending outward from the surfaces of the disks. In a preferred embodiment, the protruding nibs have a cylindrical shape, although other suitable shapes also may be used. As shown in FIG. 1A, a spacer 11 also may be used between the top combination disk 7 and the middle combination disk 8 so that the top combination disk 7 will move only when the nibs of these two disks contact each other. The spacer 11 is keyed or retained by the anti-rotate plate 5, which is held in position by the inner case 1. In the embodiment shown in FIGS. 1A and 1B, the spacer 11, has a protrusion 27 on its interior edge that mates with an elongated slot 28 on the anti-rotate plate 5 so that the spacer 11 does not rotate when the dial 13 is turned. As shown in FIG. 1B, the anti-pick washer 10 may be similarly constructed to prevent rotation. The nib 26 angular positions relative to the clearance pockets 25 of the combination disks determines the particular combination for the lock. Thus, proper positioning of the clearance pockets 25 allows the bolt 29 of the pushbutton 3 to travel into the open position so that the lock may be opened.

The combination upset disk 6 is driven by friction from the top combination disk 7. In one embodiment, the combination upset disk 6 has dimples 30 that provide adequate friction with the top combination disk 7. In a preferred embodiment, the combination upset disk 6 has three dimples 30 spaced apart from each other by relatively the same distance. The combination upset disk 6 also has a tab 31 extending towards the top of the lock, preferably having an angle approximately 90 degrees from the combination upset disk 6. The tab 31 is used as a stop that contacts the pushbutton 3 at the button stop 32. As described more fully below, the tab 31 aligns a cam surface 33 of the combination upset disk 6 with a cam surface 34 of the pushbutton 3. Preferably, the tab 31 also aligns the clearance pocket 25 of the combination upset disk 6 to the bolt 29 of the pushbutton 3. In this position, the top combination disk 7 will slide past the dimples 30 on the combination upset disk 6. The tab 31 is then in position to be pulled by the pushbutton 3 by the button pull feature upon closure of the shackle 14.

After properly turning the dial 13 to its first position corresponding to the lock combination, the dial 13 is then rotated counter-clockwise past the second position once and then stopped the second time the indicator is aligned with the second position of the combination. This engages the nibs 26 of the combination cam disk 9 and the middle combination disk 8, but allows for the position of the combination upset disk 6 and top combination disk 7 to be unchanged. Preferably, this turning the dial to its second position aligns the middle combination disk 8 clearance pocket 25 with the bolt 29 of the pushbutton 3 to the proper position for opening the lock. During this rotation, the nibs 26 of the middle combination disk 8 and the top combination disk 7 do not engage. Therefore the top combination disk 7 and the combination upset disk 6 clearance pockets remain aligned with the bolt 29 of the pushbutton 3.

The dial 13 is then rotated clockwise to its third and last position to align the clearance pocket of the combination cam disk 9 with the bolt 29 of the pushbutton 3. The combination cam disk 9 is keyed to the dial 13 and oriented such that the clearance pocket 25 is aligned with the last position in the combination. In one embodiment, the combination cam disk is retained within the lock by deforming material on the top interior surface of the dial 13.

After the combination has been properly entered, the pushbutton 3 is depressed until the front face of the button cover 12 is flush with the front face of the outer shell 15. In one embodiment, pressing the pushbutton 3 inwards causes button springs 18 to compress so that they will return the pushbutton 3 to its original position after it is released by the user. One of ordinary skill in the art would appreciate, however, that devices other than a compression spring may be used to return the pushbutton 3 to its original position after it is released. Examples of such a substitution would include using a leaf spring, torsion spring, rubber-type bellows, compressible grommet, or the like.

During the travel of the pushbutton 3, the stop 32 on the pushbutton moves into the lock and aligns a clearance path to the tab 31 on the combination upset disk 6. The cam 34 of the pushbutton 3 then engages with the cam 33 on the combination upset disk 6 and rotates the disk clockwise. After the pushbutton 3 has engaged with the combination upset disk 6, the disk will be positioned such that the pushbutton 3 will continue to rotate the disk clockwise by pulling on the tab 31 when the pushbutton 3 is returned to its original position.

The pushbutton 3 communicates with a blocker 4 so that when the pushbutton 3 is depressed the blocker 4 moves towards the back of the lock by compressing a blocker spring 17. The blocker spring 17 shown in FIG. 1A is a coiled spring, but other materials or spring constructions may be substituted as mentioned above for springs 18. In addition, a plurality of springs or materials also may be used. This movement aligns the cavity 35 in the blocker 4 with the ball bearings 19 that retain the shackle 14 in its locked position. The pushbutton 3 is held in this position until the shackle 14 is opened either by pulling down on the lock while the shackle 14 is retained by the item it is locked to, or by lifting the shackle 14.

In one embodiment, the pushbutton 3 remains in its depressed position as long as the shackle 14 is in an unlocked, or open position. In this embodiment, the long leg of the shackle 14 holds the ball bearing 19 in the blocker cavity 35. When the shackle 14 is returned to its locked position, the pushbutton 3 returns to its original position. Preferably, this is accomplished because the ball bearings 19 are allowed to move into the notches 36 of the shackle 14 when the shackle 14 is closed. The stored energy of the button springs 18 and blocker spring 17 then return the pushbutton 3 and blocker 4 to their home positions. Preferably, the cumulative force of the button springs 18 and blocker spring 17 should be sufficient to return the bearings 19 into a locked position, cause the pushbutton 3 to return to its original position, and rotate the combination upset disk 6 and top combination disk 7 out of alignment.

Once the pushbutton 3 and blocker 4 have returned to their home positions, the button pull feature 37 communicates with the tab 31 of the combination upset disk 6 to move the clearance pocket 25 out of alignment. After the combination upset disk 6 has been rotated out of alignment, the pushbutton 3 cannot be depressed without re-dialing the combination. In a preferred embodiment, the pushbutton 3 has a bolt 29 that moves in and out of the clearance pockets only when they are properly aligned, but prevents the pushbutton 3 from being depressed if the clearance pockets are not properly aligned.

With the above description of the structure and operation of the combination lock in mind, several features of the present combination lock are described in even greater detail below.

One feature of the present invention, illustrated in FIGS. 2A–D, is the automatic combination upset. Most combination locks provide a feature which scramble the internal combination to secure the shackle from opening again once it is closed. While a number of methods are used in the market, the automatic combination upset of the present invention has several features not found in the prior art. Some novel features of the present invention include the use of a clutching mechanism, the movement of the push-button 3, and the movement of the combination upset disc 6. Once the combination upset disc 6 is moved, for example, the clearance pocket 25 of the disk moves out of alignment with the pushbutton 3. In one embodiment, the movement of the combination upset disk 6 also causes the top combination disk 7 out of alignment as well.

Figure 2A:
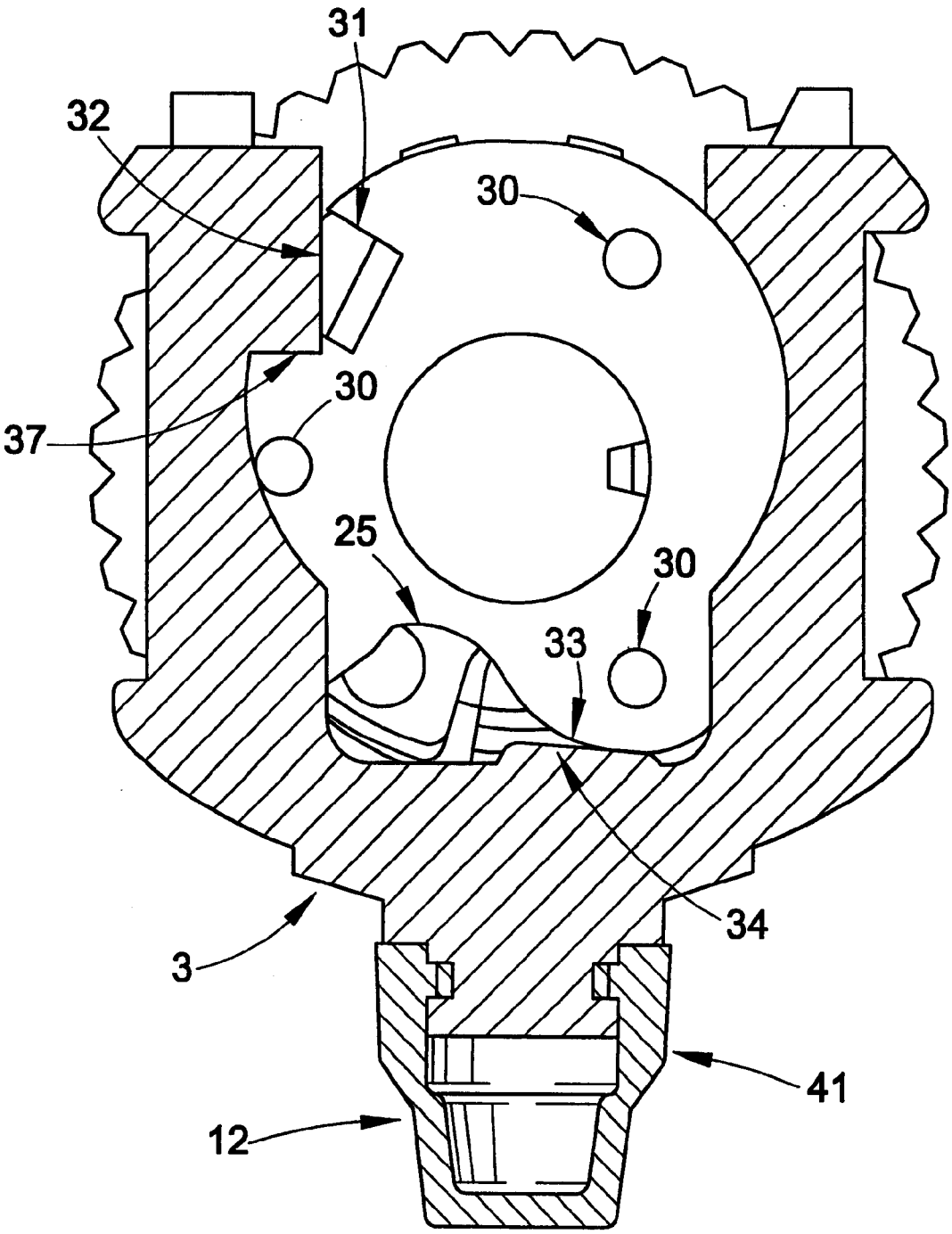
FIGS. 2A–D are sectional views of a combination lock having an automatic combination upset of the present invention.

As described above, the first number or dial position of the combination sequence properly positions the combination upset disk 6 and the top combination disk 7 so that completion of the combination will allow the lock to be opened. When dialing the first number, the user is typically instructed to rotate the dial three revolutions in the clockwise direction. The present design utilizes an upset-clutch positioned on top of the combination disc 7 with pressure applied via the combination disc spring 23. As shown in FIG. 2A, the tab 31 on the combination upset disk 6 is positioned against a stop 32 on the pushbutton 3 when the dial 13 is properly turned to the first position of the combination. Once the tab 31 contacts the stop 32, additional rotational movement of the dial 13 causes the combination upset disk 6 to remain in place while the top combination disk 7 continues to rotate under frictional forces applied by the stationary combination upset disk 6.

In one embodiment, the clutching mechanism comprises a dimpled protrusion 30 on the combination upset disk 6 that presses against the upper surface of the top combination disk 7. Preferably, the top combination disk has a recess 38 that receives the dimpled protrusion 30 to provide greater resistance to slippage when the first number of the combination is being entered. Once the combination upset disk 6 is positioned against the stop 32, however, further rotation of the dial 13 will cause the dimpled protrusion 30 to slide out of the recess 38.

The dial is then turned to the first number of the combination so that the clearance pocket of the top combination disk 7 is properly aligned. Once the first number or position of the combination is properly dialed, no more force is applied to either the top combination disk 7 or the combination upset disk 6 while the remainder of the combination is properly entered. Thus, after the dial 13 is turned to the first position of the combination, no more clutching or slippage between the combination upset disk 6 and the top combination disk 7 is required.

Figure 2B:
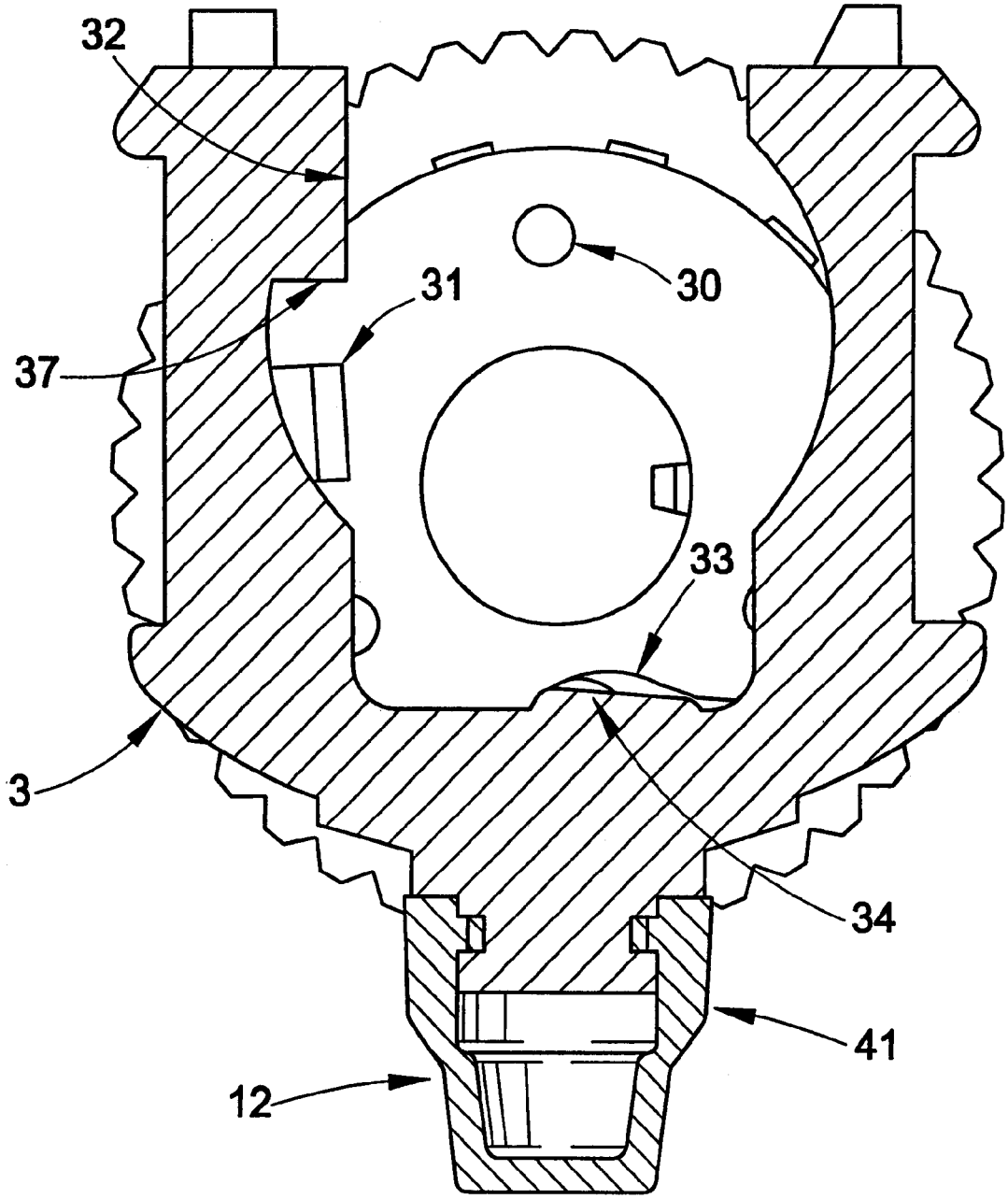
Figure 2C:
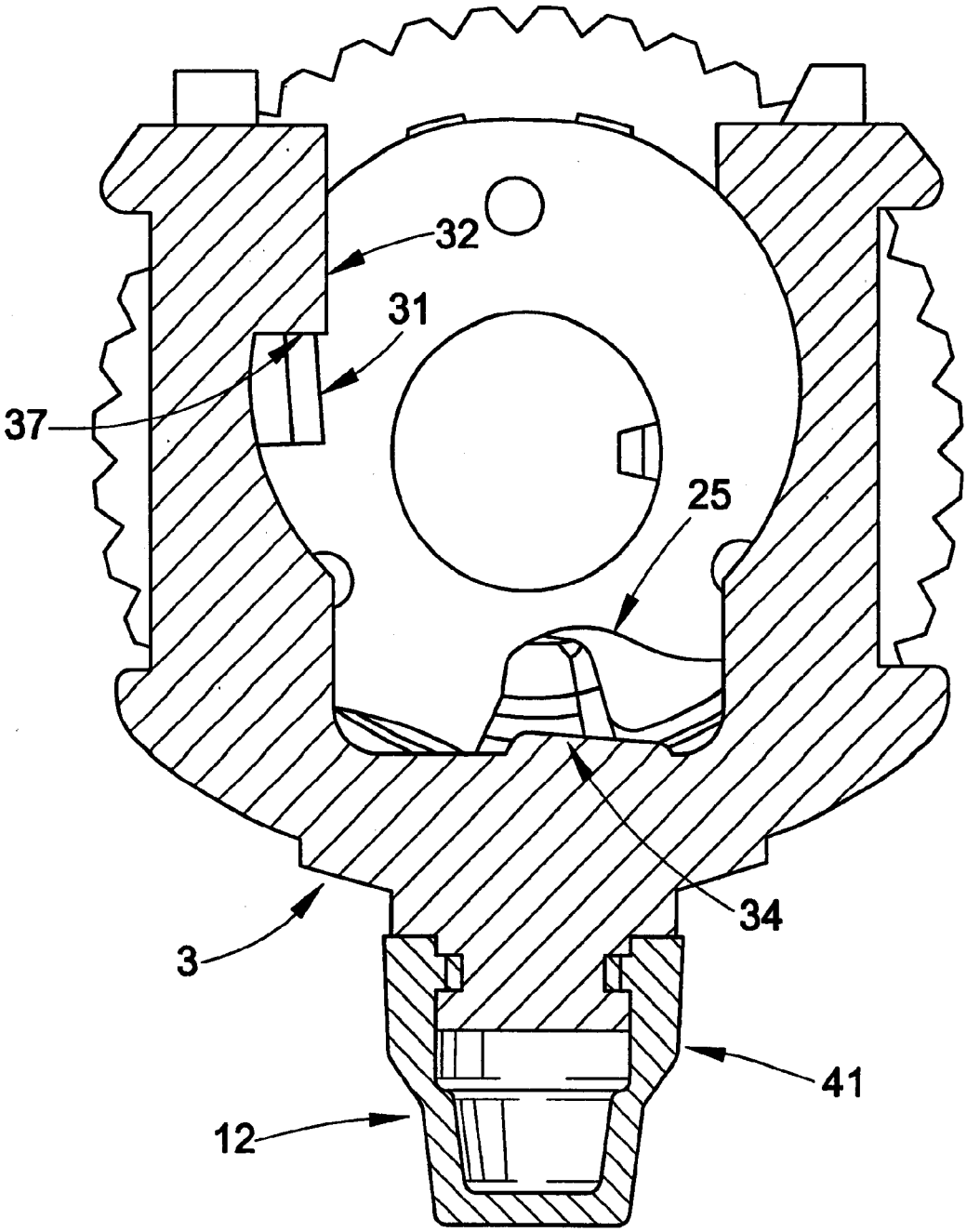
Figure 2D:
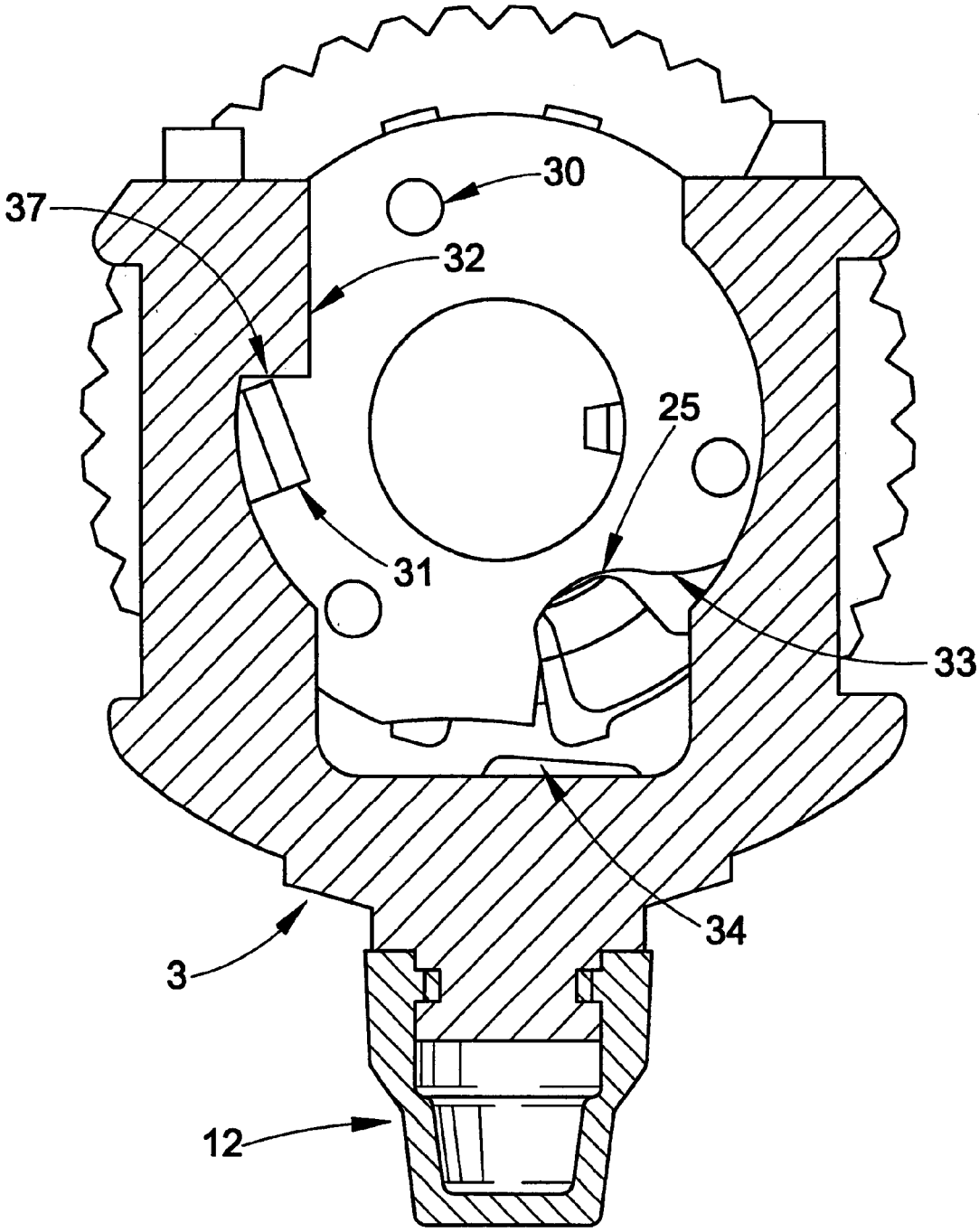

Ultimately the entire combination is dialed and the pushbutton 3 is depressed to allow the ball bearings 19 to travel and open the lock. When the pushbutton 3 is depressed, the stop 32 moves out of contact with the tab 31 on the combination upset disk 6. As the button is further depressed, a cam surface 34 of the pushbutton 3 contacts a cam surface 33 of the clearance pocket of the combination upset disk 6. FIG. 2B illustrates that after these cam surfaces are engaged, further inward movement of the lock causes the combination upset disk 6 to rotate due to sliding between the cam surfaces. Preferably, this rotation causes the tab 31 of the combination upset disk 6 to rotate behind the stop 32 of the pushbutton 3. As illustrated in FIGS. 2C and 2D, this preferred embodiment allows the combination upset disk to be rotated out of alignment with the pushbutton 3 as the pushbutton returns to its original position. First, the cam surfaces 33 and 34 cause the tab 31 to be rotated so that the pull 37 engages with the trailing edge of the tab 31 as the pushbutton 3 begins to move outward toward its original position. Once the pull 37 contacts the tab 31, further outward movement of the pushbutton 3 causes the pull 37 to rotate the combination upset disk. The rotation of the combination upset disk 6 moves the clearance pocket 25 out of alignment, thereby preventing the pushbutton 3 from being depressed until the combination is reentered. In one embodiment, the pushbutton 3 is sufficiently retracted from the clearance pockets of the disks to also cause the top combination disk 7 to rotate due to frictional engagement with the combination disk 6. Preferably, the top combination disk 7 is also rotated so the clearance pocket is no longer in alignment with the pushbutton 3.

Figure 3A:
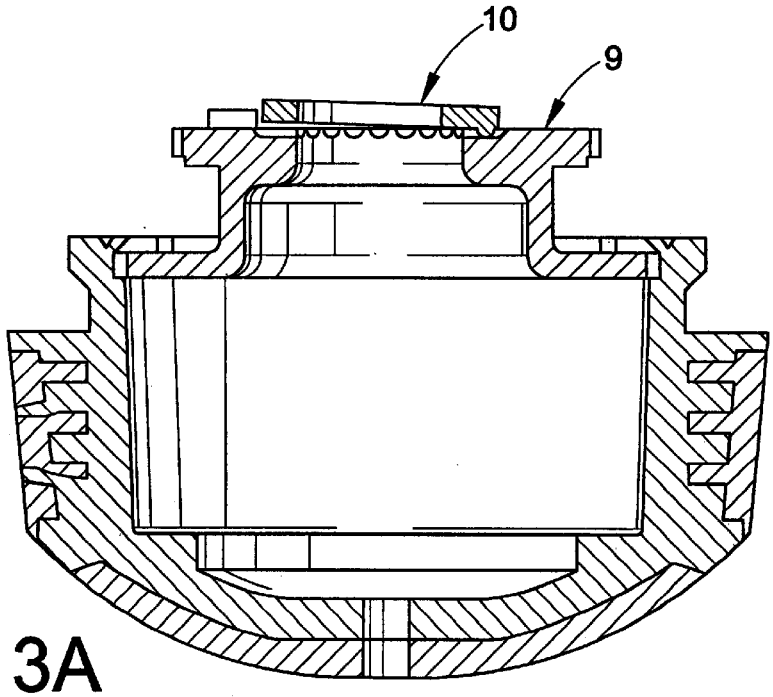
FIGS. 3A–C are views of a dial indexing feature of a combination lock of the present invention.
Figure 3B:
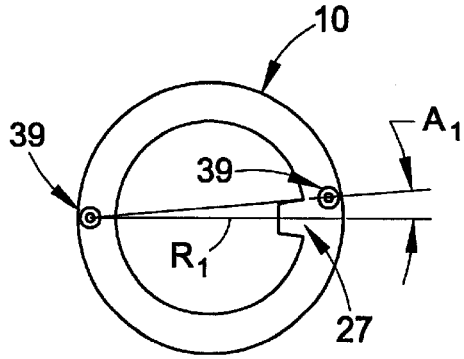
Figure 3C:
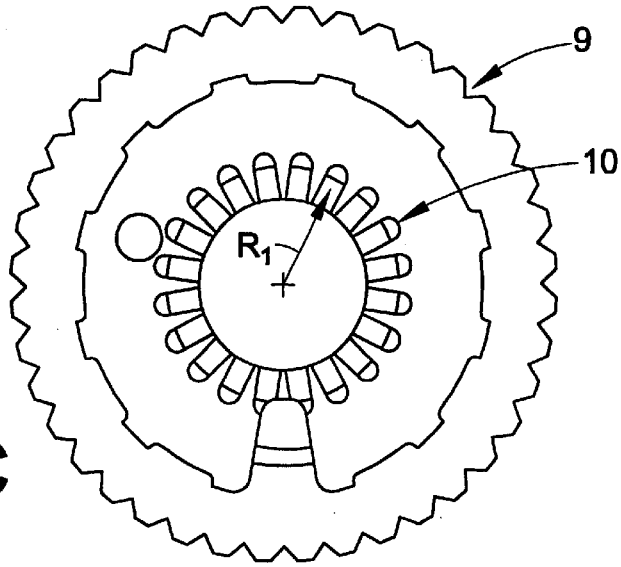

As illustrated by FIGS. 3A–C, another feature of the present invention not present in conventional combination locks is the orientation and operation of the dial 13. In addition to the orientation of the pushbutton 3 operating in a direction approximately normal to the axis about which the dial 13 is turned, the dial operation also offers the user tactile features by providing a soft feel and rotational feedback in the form of a "click" or detent feature. In use, rotation of the dial 13 produces a "ratchet like" sound by providing one "click" per number or symbol on the dial 13. Alternatively, the rotational feedback may be provided for larger increments on the dial instead of for every number, such as by providing a "click" at every fifth numeral or symbol on the dial. Preferably, this responsive click is produced by the addition of features on pre-existing components of the lock. That is, in the preferred embodiment does not require the addition of parts to provide the responsive click because parts used for other purposes are modified to include this feature.

In one embodiment, the combination discs are biased down by a spring 23 to properly position the combination discs. Two detents 39, or dimples, are provided on an anti-pick washer 10, while the combination cam disk 9 includes a plurality of pockets 40 distributed around its outer edge. The detents 39 are offset by one-half the angular distance between the pockets 40 so that only one dimple can rest in a pocket at a time. Thus, in a preferred embodiment where the dial 13 has 40 numbers, the combination cam disk 9 has 20 pockets to create 40 correlating index points where the detents 39 and pockets 40 create a click.

This dial index feature can be modified in several ways without departing from the spirit and scope of the present invention. As mentioned above, for instance, fewer clicks can be created by reducing the number of pockets 40. In addition, the size of the detents can be varied to control the degree of "click" or resistance provided to the user. In order to accommodate this feature, with the size of the radius $R_1$ being relatively small, two dimples are provided on the anti-pick washer 10; and in a preferred embodiment shown in FIG. 3B, they are positioned opposite one another with one being shifted at an angle $A_1$ that is equivalent to one combination number spacing, or one-half the angular distance between the pockets. When the dial 13 is turned, the anti-pick washer 10, which has an internal tang 27 or other suitable structure to prevent rotation, simply rocks back and forth when the detents 39 enter and exit the pockets 40.

Figure 4A:
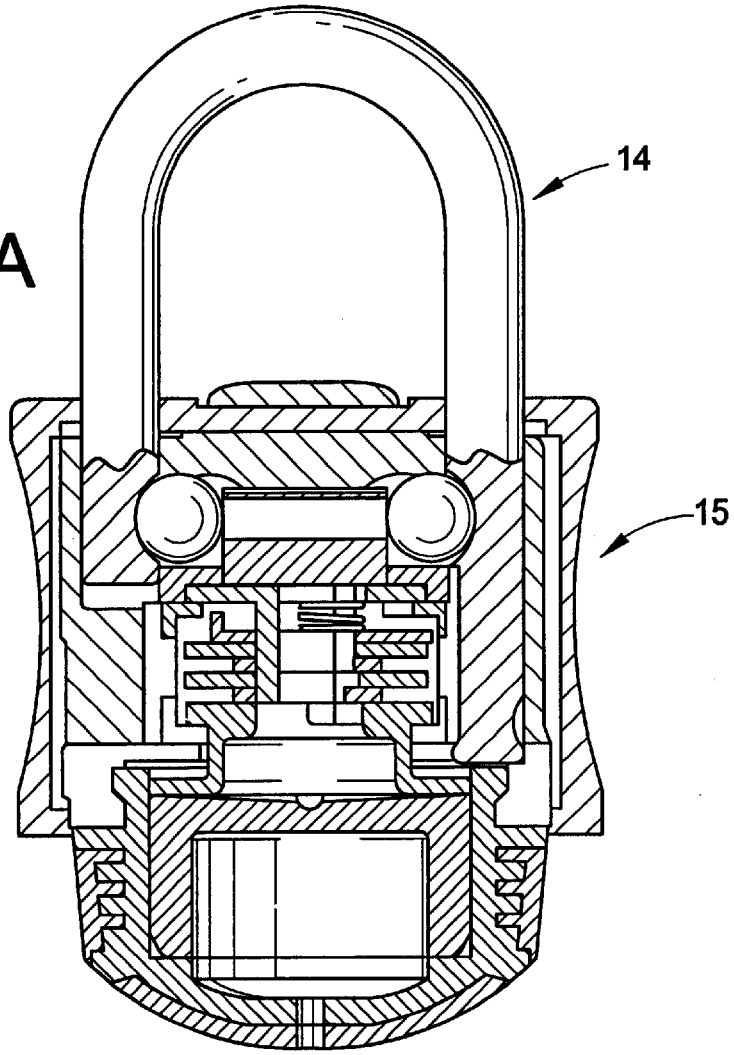
FIGS. 4A–B are sectional views of mass customization features of a combination lock of the present invention.
Figure 4B:
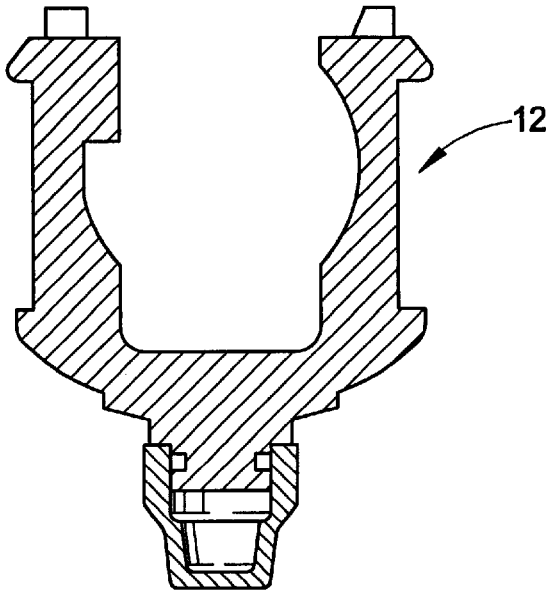

Turning to FIGS. 4A–B, another feature of the present invention is the ability to accommodate different outer shell designs without compromising the assembly or performance of the lock. During assembly, the outer shell 15 and button cover 12 of the lock are the final components to be assembled onto the lock. Preferably, these items have a snap on design that allows for relatively quick final assembly. This allows lock assemblies to be mass-produced in bulk while the final steps of adding the outer shell 15 and button cover 12 can be customized and added just prior to shipment to a customer.

While these outer components may provide additional security and ease of use, they are not required to ensure the functionality or the weather resistance of the lock. The cap insert 21, shown in FIG. 1, allows the outer shell 15 to be assembled over the shackle 14 without allowing the inner case 1 to be exposed. The outer shell 15 can be made with different colors or exterior shapes to conform to customer demand.

The cap insert 21 also allows for greater customization of the lock without sacrificing lock integrity. In one embodiment, shown in FIG. 1, the cap insert 21 functions as a logo holder, thereby allowing the lock to be further customized to include a customer's logo 22 on the top of the lock. The cap insert 21 itself can be added after the lock is assembled, but preferably is added before the outer shell 15. In addition, it is further preferred that the outer shell 15 is assembled over the lock before the button cover 12 is applied to the pushbutton 3. These features allow for convenient product customization by color, form, or with a logo.

Several design elements allow for the snap-on case. The inside of the lock is covered by the outer shell 15 and is designed such that the outer shell 15 can be applied over the majority of the distance over the lock without presenting undo stress to the case. Furthermore, the material for the outer shell 15 is engineered so the final stress applied when it is required to flex does not exceed the properties of the material and show signs of failure. Finally, the distance the bottom cover flange 9 extends into the inside of the case 1 must accommodate both of the above conditions. This same distance is designed to be positioned as close to the outside diameter as possible to prevent an edge from being exposed on the product, which may permit tampering by vandals.

Preferably, the cover 12 for the pushbutton 3 is attached after the outer shell 15 is applied. In one embodiment, the outer shell 15 is assembled to the lock by first dialing the proper combination, depressing the pushbutton 3 so that it is flush with the lock casing, and then applying the outer shell 15.

To prevent tampering with the plastic button cover 12, the size of the button cover openings in the outer shell 15 and in the lower casing 2 require a specific relationship. To apply the button cover 12, the lock may be dialed to the proper combination, which allows the pushbutton 3 to be depressed. A raised edge 41 on the button cover 12 itself, which defines a cam surface, allows the button cover 12 to apply force to the pushbutton 3 and move both pieces further into the lock. The size of the opening in the outer shell 15 is tight enough such that the plastic button cover 12 is not allowed to expand thereby allowing both pieces to move in. However, the button opening in the lower casing 2 is large enough so that when the travel of the pushbutton 3 is at the fullest, additional force on the button cover 12 allows the cover to expand over the raised edge 41 on the pushbutton 3 until it causes the internal surface of the button cover 12 to snap into a receiving groove 103, as shown in FIG. 2B, on the pushbutton 3. One skilled in the art would appreciate that there are several alternative structures that would provide for convenient, customized final assembly of the lock without departing from the spirit and scope of the invention. For instance, tabs, detents or similar structures may be interconnected with receiving grooves. Preferably, the snap on the feature of the outer shell 15 and button cover 12 should be resistant to prying off by an unauthorized person attempting to open the lock.

The pushbutton 3 and button cover 12 of the present invention also provide increased security than found in the prior art. Combination locks that require the motion of a latch, lever, or button after the combination has been entered typically can be opened or violated by applying excessive force to the latch, lever, or button. The pushbutton 3 and button cover 12 of the present invention help prevent unauthorized opening of the lock in this manner. When the lock is completely assembled, the button cover 12, which is assembled over the pushbutton 3, extends outward from the outer shell 15 so that a user can push the button cover 12 to open the lock. If an unauthorized person tries to open the lock by applying a force to the pushbutton 3, in an attempt to cause the pushbutton 3 or one or more disks to collapse or to deform, the button cover 12 will collapse or deform before the force required to move the pushbutton 3 is reached. This results in the button cover 12 being crushed to the front surface of the outer shell 15. Continued impacts with a blunt object will be absorbed by the outer shell 15 before the pushbutton 3 can be moved sufficiently inwards to open the lock. Thus, the present invention provides increased resistance to attacks by blunt forces to the button cover 12 than provided in the past.

Another feature of the present invention is its improved security over conventional combination locks. Many times padlocks are abused with violation in mind. Some products on the market today allow a would-be thief to apply a force against the padlock that can cause the lock to open. For example, many spring loaded locks can be opened by rapping the lock in order to move a spring loaded latch or blocker. This occurs when momentum is transferred to the mass of the latch or blocker allowing the lock to open. In addition, locks that utilize only one leg of the shackle for security may also be susceptible to unauthorized opening by applying inertial forces. In contrast, the present invention utilizes an "anti-rap" feature to protect against these attacks. As shown in FIG. 1, a hook 42 on the pushbutton 3 retains a hook catch 104, as shown on FIG. 1B1, on the blocker 4 so that the blocker 4 can not be moved into the open position by impacting the lock.

The present invention is less susceptible to attack by rapping the lock due to a connection between the pushbutton 3 and the blocker 4. Unless the combination is dialed, the clearance pockets 25 in the combination discs are not aligned to allow the pushbutton 3 and blocker 4 to travel. Thus, without proper alignment of the clearance pockets, the pushbutton 3 cannot be depressed or shifted with inertial forces.

Figure 5A:
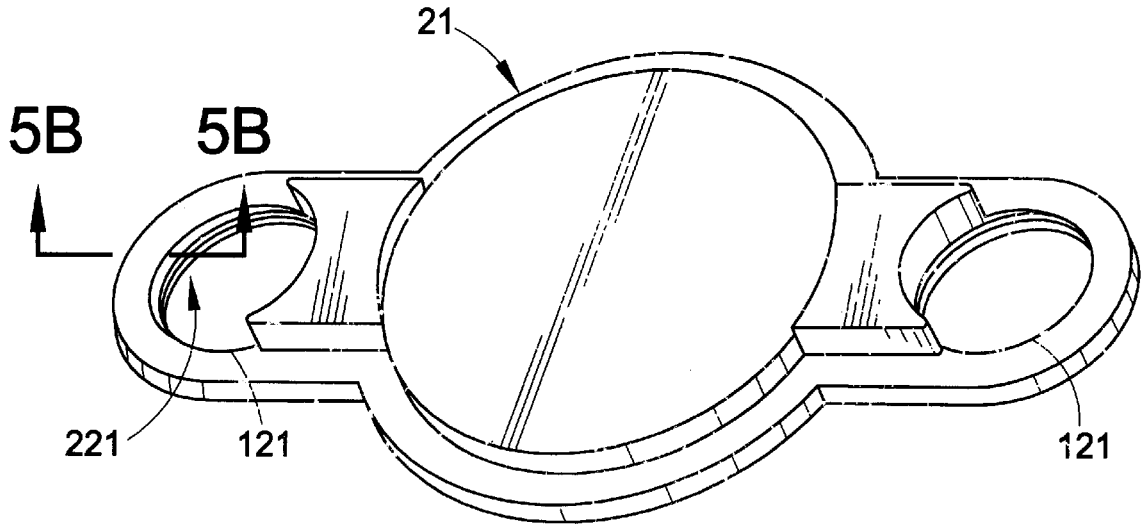
FIG. 5A is perspective view of a cap insert of a combination lock of the present invention.
Figure 5B:
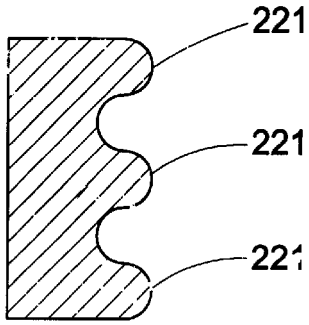
FIGS. 5B–C are enlarged sectional views of a portion of a cap insert of a combination lock of the present invention.
Figure 5C:
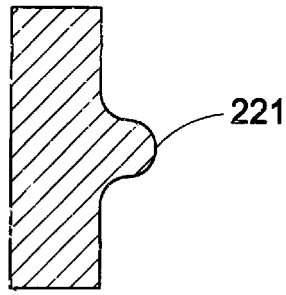

Another feature of the present invention is its increased weather resistance. The cap insert 21 can be made of a relatively soft material with through holes 121 slightly smaller than the shackle diameter. Preferably, the material has a hardness from about 20 to about 80 shore A, more preferably from about 30 to about 60 shore A. When the shackle 14 is installed, the through holes 121 operate like a gasket seal, thereby helping prevent water, dust, or other unwanted impurities from entering the interior of the lock. Alternatively, the through holes 121 may have a diameter approximately the same as or slightly larger than the shackle 14, with ribbed portions 221, as shown in FIGS. 5A–C, extending therefrom to seal against the shackle 14. The use of the ribs 221 may reduce the frictional force caused by extracting or inserting the shackle while still providing weather resistance. In addition, it is less likely for water or dust to enter the lock through the dial 13 because it is located on the lower side of the lock.

Although the present invention has been illustrated and described with reference to the many embodiments described herein, it should be understood that the features, structures, and embodiments described above are capable of numerous modifications without departing from the spirit and scope of the present invention.

What is claimed is:

1. A combination lock comprising:

a lock housing;

a shackle;

a rotatable dial on the surface of said housing;

a combination assembly within said housing and in communication with said rotatable dial, wherein the combination assembly comprises a plurality of combination disks having windows that can be rotatably aligned to open the lock;

a combination upset disk within said housing and in communication with said rotatable dial, wherein said combination upset disk comprises:

a window that can be rotatably aligned with the windows of said plurality of combination disks to open the lock, and a tang extending from said combination upset disk;

a pushbutton extending out of said housing that opens the lock when it is depressed, wherein said pushbutton comprises:

a stop member that contacts said tang to position the window of the combination upset disk before the pushbutton is depressed, and means for rotating the window of the combination upset disk out of alignment after the pushbutton is depressed so that the combination must be reentered in order to open the lock.

2. A combination lock comprising:

a lock housing;

a shackle;

a rotatable dial on the surface of said housing;

a combination assembly within said housing and in communication with said rotatable dial, wherein the combination assembly comprises a plurality of combination disks having windows that can be rotatably aligned to open the lock;

a pushbutton on the surface of said housing that opens the lock when it is depressed, wherein said pushbutton comprises a stop member that contacts a tang to position the window of one of said plurality of combination disks before the pushbutton is depressed;

wherein the pushbutton operates in a direction perpendicular to the rotational axis of said dial.

3. A combination lock comprising:

a lock housing;

a shackle;

a rotatable dial on the surface of said housing;

a combination assembly within said housing and in communication with said rotatable dial, wherein the combination assembly comprises a plurality of combination disks having windows that can rotatably aligned to open the lock;

a pushbutton extending out of said housing that opens the lock when it is depressed, wherein said pushbutton comprises:

a stop member that contacts a tang to position the window of one of said plurality of combination disks before the pushbutton is depressed, and means for rotating the window of said one of said plurality of combination disks out of alignment after the pushbutton is depressed so that the combination must be reentered in order to open the lock; and a pushbutton cover disposed on said pushbutton, wherein said cover prevents unauthorized opening of the lock when subjected to high impact forces.

4. A combination lock comprising:

a lock housing;

a shackle;

a rotatable dial on the surface of said housing;

a combination assembly within said housing and in communication with said rotatable dial, wherein the combination assembly comprises:

a plurality of combination disks having windows that can be rotatably aligned to open the lock; and dial detent means;

a pushbutton extending out of said housing that opens the lock when it is depressed, wherein said pushbutton comprises a stop member that contacts a tang to position the window of one of said plurality of combination disks before the pushbutton is depressed.

5. A combination lock comprising:

a lock housing;

a shackle extending into said lock housing;

a cap insert within said housing, wherein said insert defines through holes that surround the shackle extending into said lock housing;

a rotatable dial on the surface of said housing;

a combination assembly within said housing and in communication with said rotatable dial, wherein the combination assembly comprises a plurality of combination disks having windows that can be rotatably aligned to open the lock;

a pushbutton extending out of said housing that opens the lock when it is depressed, wherein said pushbutton comprises a stop member that contacts a tang to position the window of one of said plurality of combination disks before the pushbutton is depressed.

6. The combination lock of claim 5, wherein the through holes of said cap insert have a diameter slightly less than said shackle.

7. The combination lock of claim 5, wherein the portion of said cap insert that surrounds said shackle has one or more ribs.

* * * * *